United States Patent [19]

Barfus

[11] Patent Number: 4,721,455

[45] Date of Patent: Jan. 26, 1988

[54] BIRTHDAY CAKE COVER AND CANDLE HOLDER

[76] Inventor: Irving Barfus, 824 Hoover St., Los Angeles, Calif. 90005

[21] Appl. No.: 931,146

[22] Filed: Nov. 17, 1986

[51] Int. Cl.[4] ..... F23D 3/16

[52] U.S. Cl. ..... 431/295; 206/45.32; 206/542; 431/296

[58] Field of Search ..... 206/45.32, 542; 312/284; 428/7; 431/253, 292, 295, 296; D7/83

[56] References Cited

U.S. PATENT DOCUMENTS

| | | | |
|---|---|---|---|
| 1,511,004 | 10/1924 | Pooch et al. | 431/295 X |
| 1,778,597 | 10/1930 | Herzog | 431/295 |
| 1,879,477 | 9/1932 | Powell | 431/295 X |
| 1,982,723 | 12/1934 | Bantleon et al. | 431/253 X |
| 2,393,767 | 1/1946 | Gould | 431/253 X |
| 2,406,777 | 9/1946 | Koretzky | 431/296 |
| 2,468,505 | 4/1949 | McNeill | 431/295 X |
| 2,960,770 | 11/1960 | Valenta | 431/253 X |
| 3,736,214 | 5/1973 | McBirnie | 312/284 X |
| 3,819,455 | 6/1974 | MacKendrick | 431/295 X |
| 4,219,119 | 8/1980 | Zefran | 312/284 X |

FOREIGN PATENT DOCUMENTS

| | | | |
|---|---|---|---|
| 804283 | 1/1969 | Canada | 428/7 |
| 7527560 | 10/1977 | France | 431/295 |
| 584870 | 11/1958 | Italy | 431/295 |

*Primary Examiner*—Stephen Marcus

*Attorney, Agent, or Firm*—Erik M. Arnhem

[57] ABSTRACT

A cake cover and candle support a cylindrical center support configured to be inserted into a birthday cake or the like and defining a extended portion. A planar cake cover defines a center aperture and a plurality of candle receiving recesses. The cake cover is received upon and supported by the center support above the upper surface of a cake.

12 Claims, 8 Drawing Figures

BIRTHDAY CAKE COVER AND CANDLE HOLDER

FIELD OF THE INVENTION

This invention relates generally to decorative cakes and pastries and particularly to birthday cakes having a decorative upper surface and for which a plurality of candles are used in celebration of a birthday or similar occasion.

BACKGROUND OF THE INVENTION

Through the years a familiar custom has evolved in which birthdays and similar occasions are celebrated using a symbolic cake which is decorated with appropriate figures and legends fashioned from pastry icing or the like. In accordance with the evolving custom, a number of candles, often representative of the age of the birthday celebrant, are embedded in an upright position on the cakes upper surface. Thereafter, the candles are lit and the celebrant is invited to attempt to blow the candles out, usually with the object of accomplishing the extinguishing of all candles in a single breath. After the celebrant has successfully blown out all of the candles, the candles are removed and the cake is divided among the remaining celebrants and guests and is eaten.

While the foregoing described custom is one gayly celebrated and enthusiastically entered into by the participants, there are several aspects of it which provide somewhat undesirable side effects. For example, many persons feel uncomfortable about the consumption of a cake right after the birthday celebrant has blown the candles out for fear of some unsanitary aspect. In addition, the embedding of the candles in the frosting and decorative icing and their removal prior to cutting the cake before consumption, generally results in partially ruining the decorative icing and frosting. Finally, the embedding of the candles in the icing and removal therefrom, frequently wastes a substantial part of the frosting and decorative icing because of its tendency to adhere to the candles which are ultimately thrown away. Moreover, the candles, which are generally made of wax, after even short period of burning, often drip melted wax upon the surrounding cake surface which, must itself, be removed prior to cutting.

Because of the foregoing problems, there has arisen a need in the art for a better approach to the celebration of occasions such as a birthday in which candles are placed upon a decorated cake and extinguished by blowing of one or more participants.

SUMMARY OF THE INVENTION

Accordingly, it is a general object of the present invention to provide an improved birthday cake cover and candle holder. It is a more particular object of the present invention to provide an improved birthday cake cover and candle holder which provides the excitement and enjoyment of the customary birthday cake celebration while avoiding the above-described difficulties associated with embedding candles in the surface of the decorated cake.

In accordance with the invention, there is provided an improved birthday cake cover and candle holder having a center support suitable for placement in the body of a decorated cake and a substantially planar candle support having means for mounting to and being supported by the support member and having means for supporting and retaining a plurality of birthday candles.

The support and the planar member cooperate to retain the birthday candles above the upper surface of the birthday cake and facilitate the customary birthday cake candle lighting and extinguishing by the celebrant's blowing action.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which, like reference numerals identify like elements and in which:

DESCRIPTION OF THE PREFERRED EMBODIMENTS

Figure 1:
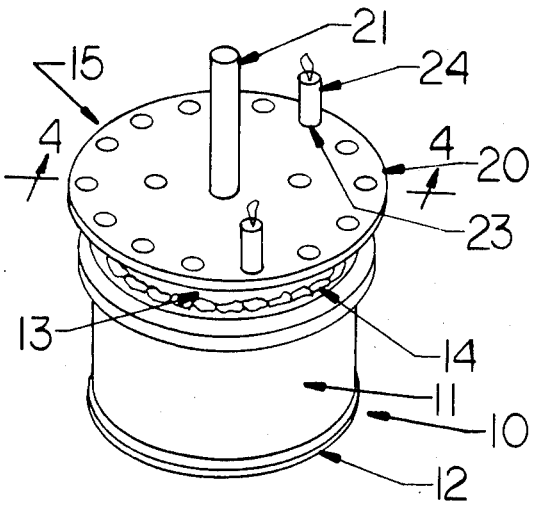
FIG. 1 is a perspective view of a birthday cake cover and candle holder constructed in accordance with the present invention.

FIG. 1 sets forth a perspective view of the present invention birthday cake cover and candle holder in a round configuration. A birthday cake 10 comprising a substantially cylindrical typical cake has an upwardly extending side 11, a bottom surface 12 and a top surface 13. In accordance with custom, top 13 of cake 10 supports an arrangement of decorative icing and frosting decorations 14. A cake cover and candle holder constructed in accordance with the present invention, is generally referenced by reference numeral 15 and includes a substantially planar cover member 20 having a generally circular configuration and defining a center aperture 25. Cover 20 further defines a top surface 22 which is generally flat and which defines a plurality of candle recesses 23 spaced about surface 22. In accordance with an important aspect of the present invention, candle recesses 23 support a plurality of candles 24 which are, in accordance with the users desires, placed in several or all of the available candle recesses 23 in surface 22 to achieve the desired number and pattern. It will be apparent to those skilled in the art that while candles 24 are shown in the pattern of FIG. 1, any number of candles, up to the total number of available candle recesses 23, may be utilized without departing from the spirit and scope of the present invention. Cake cover and candle holder 15 further includes a cover support 21 which comprises a generally elongated cylindrical member which passes through center aperture 25 of cover 20 and by means seen better in FIG. 4, supports cover 20 above decorations 14 of cake 10. In accordance with an important aspect of the present invention, it should be noted that while any size of shape of cover 20 may be utilized in practicing the present invention, it is preferable that cover 20 extend at least to the outer perimeter of cake 10 in order to achieve the maximum benefits of the present invention.

Figure 2:
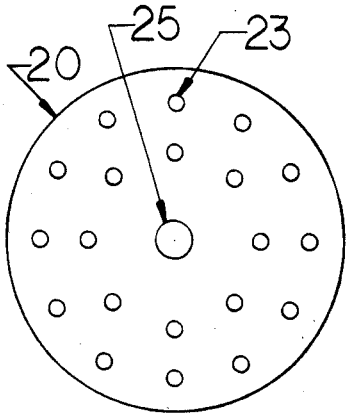
FIG. 2 is a top view of the birthday cake cover and candle holder shown in FIG. 1.

FIG. 2 sets forth a top view of the cake cover and candle holder 15 shown in FIG. 1 in which the circular shape of cover 20 is readily apparent. As can be seen, a plurality of candle recesses 23 are spaced about the surface 22 of cover 20 in accordance with the preferences of the design of cover 20. As is further apparent in FIG. 2, cover 20 defines a centered aperture 25 which, as mentioned, cooperates with cover support 21 to retain cover 20 above cake 10.

Figure 3:
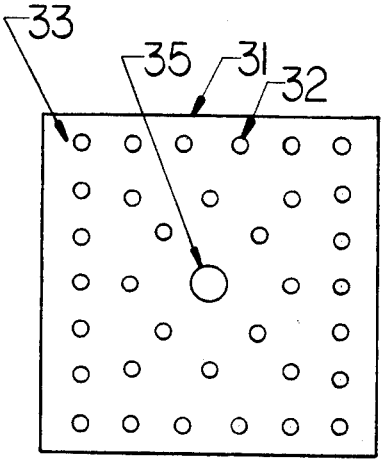
FIG. 3 is a top view of an alternate embodiment of the present invention birthday cake cover and candle holder.

FIG. 3 sets forth a top view of an alternate but similar embodiment of the present invention birthday cake cover and candle holder which, in use, would cooperate with a similar cover support to cover support 21 shown in FIG. 1. In contrast to the embodiment shown in FIGS. 1 and 2, cover 31 in FIG. 3 defines a substantially square shape having a center aperture 35 which, in similarity to center aperture 25 of cake cover 20, is configured to receive cover support 21. Cover 31 further defines a substantially planar top surface 33 which in turn defines a plurality of candle recesses 32 based about surface 33 in accordance with the designers preference.

In accordance with an important aspect of the present invention, cake covers 20 and 31 are fabricated from a clear material such as molded plastic in the preferred form to permit decorations 14 to be visible through surfaces 22 and 33 of covers 20 and 31 respectively. As will be apparent to those skilled in the art, in the preferred use, cake cover 20 is utilized in combination with cakes having a generally round or cylindrical configuration while cover 31 is better suited to use with cakes having a square or rectangular configuration. It should be apparent to those skilled in the art that while covers 20 and 31 are shown by way of example to be round and square, any number of cover shapes corresponding to any number of cake shapes, may be utilized without departing from the spirit and scope of the present invention.

Figure 4:
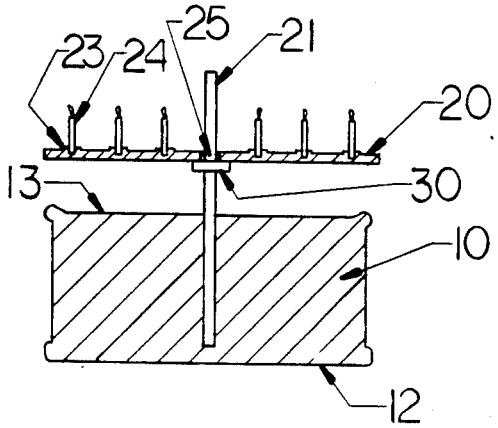
FIG. 4 is a section view of the present invention birthday cake cover and candle holder shown in FIG. 1 taken along section lines 4—4 therein.

FIG. 4 sets forth a section view of the present invention birthday cake cover and candle holder shown in FIG. 1 taken along section lines 4—4 therein. Accordingly, cake 10 is supported upon bottom 12 such that top 13 faces upwardly. Cover support 21 which, as mentioned, defines an elongated substantially cylindrical support member, is inserted into the body of cake 10 at its approximate center and is retained therein in a substantially vertical position by the mass of cake 10. Cover support 21 further defines an expanded portion 30 positioned upon cover support 21 at the desired placement of cover 20. In accordance with the invention, expanded portion 30 defines an outwardly extending ridge which is greater in expanse than center aperture 25 of cover 20. Accordingly, with cover support 21 inserted into and retained by cake 10, cover 20 is placed upon cover support 21 by passing center aperture 25 over the upper portion of cover support 21. Cover 20 is then lowered until it rests upon expanded portion 30. Candles 24 may be inserted into candle recesses 23 in cover 20 prior to the above-described placement of cover 20 upon cover support 21 rendering the candle placement function generally easier than the prior art system of inserting candles 24 directly into top 13 of cake 10. As will be apparent to those skilled in the art by examination of FIGS. 1 and 4, candles 24 are retained above top 13 of cake 10 in an orderly and efficient manner without damaging the decorations on top 13 other than the insertion of cover support 21 which of course produces a single center hole in cake 10 rather than the plurality of holes occasioned by placing candles 24 directly into top 13. As mentioned above, cover 20 is formed of a clear material, such as molded plastic, and therefore permits viewing of top 13 of cake 10 through cover 20 permitting the enjoyment of the beauty of the decorations on top 13. As will be apparent to those skilled in the art and in accordance with an important aspect of the present invention, the process of blowing out candles 24 does not result in the depositing of the birthday celebrant's breath upon top 13 of cake 10 but rather, cover 20 acts as a shield deflecting the blower's breath away from top 13 and preserving the sanitation of cake 10. In addition, once the candles have been extinguished, the entire candle assembly and cover 20, together with cover support 21, may be removed by simply grasping cover support 21 and drawing it upward and from cake 10 leaving behind a single center hole as the sole evidence of candle placement. As will be apparent, this presents much more attractive cake to be cut up and consumed by the guests at the festivities.

Figure 5:
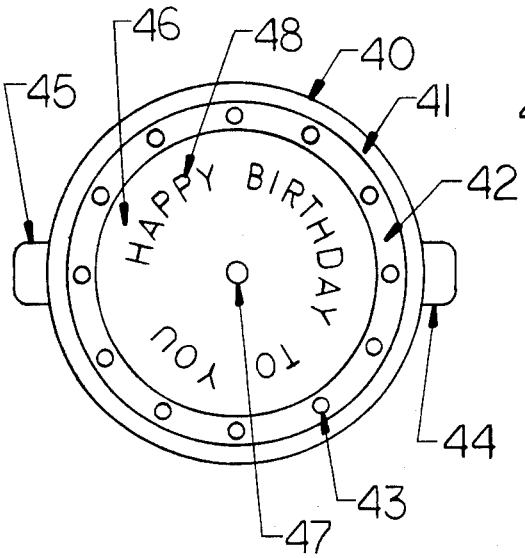
FIG. 5 is a top view of an alternate embodiment of the present invention birthday cake cover and candle holder.

FIG. 5 sets forth still another embodiment of the present invention birthday cake cover and candle holder in which a cover 40 has a generally circular shape defining an outer ring 41 and a smaller candle ring 42. Candle ring 42 defines a plurality of candle recesses 43. Outer ring 41 further defines a pair of outwardly extending handles 44 and 45 which facilitate the transporting of cover 40. An inner surface 46, having a generally flat structure, extends inwardly from candle ring 42 and defines a center aperture 47. In accordance with an important aspect of the present invention, inner surface 46 supports a message inscription 48. As a result, the embodiment shown in FIG. 5 may be utilized to support a plurality of candles in candle recesses 23 in a similar manner to that shown for cover 20 in FIGS. 1 and 4. In such use, center aperture 47 is placed upon and received by cover support 21 in a similar manner to that shown for cover 20. The added advantage of the embodiment shown in FIG. 5 is the provision for a center area bearing message inscription 48.

Figure 6:
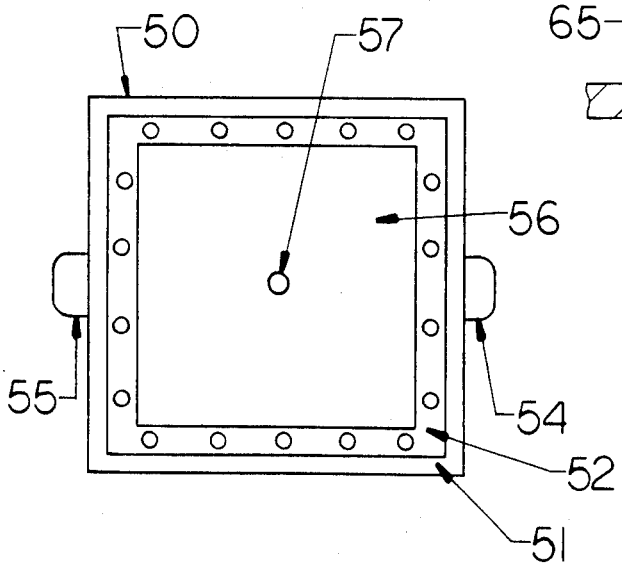
FIG. 6 is a top view of still another alternate embodiment of the present invention birthday cake cover and candle holder.

FIG. 6 sets forth still another embodiment of the present invention birthday cake cover and candle holder having a generally square configuration cover 50 having an outer border 51 and a candle border 52 positioned inwardly therefrom. Candle border 52 defines a plurality of candle recesses 53 spaced about its perimeter. Outer border 51 defines a pair of outwardly extending handles 54 and 55 which facilitate the transporting of cover 50. Cover 50 further defines an inner area 56 formed of a generally flat area and defining a center aperture 57. In accordance with the invention, center aperture 57 is sized to receive cover support 21 in the same manner as cover 20 of FIG. 1. In its preferred form, inner area 56 comprises a transparent material, such as clear plastic, which permits the unobstructed viewing of the decorations on the associated birthday cake.

Figure 7:
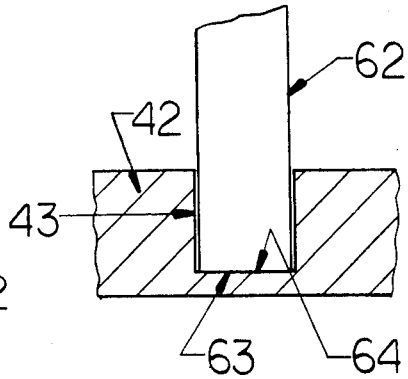
FIG. 7 is a partial section view of the candle holder portion of the present invention birthday cake cover and candle holder.

FIG. 7 shows a partially sectioned view of a typical candle recess 43 defined, for example, in candle ring 42 of cover 40. Recess 40 defines a generally cylindrical recess having a recess bottom 64. It should be noted that recess bottom 64 provides a seal of recess 43 such that no communication of the person blowing out the candles passes through recess 40 to the upper surface of the birthday cake. Candle 62 rests within recess 43 and defines a bottom end 63 which rests upon recess bottom 64. It should be noted that recess 43 supports candle 62 without the use of any adhesives or other fasteners and permits candle 62 to be easily inserted into candle ring 42 and removed therefrom.

Figure 8:
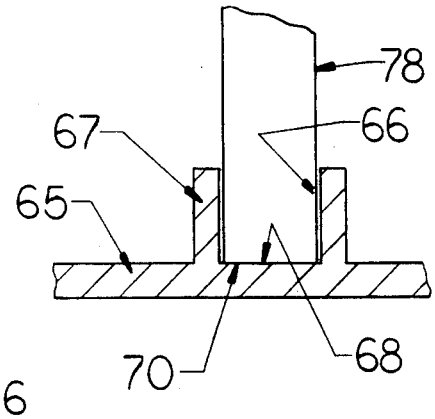
FIG. 8 is an alternate embodiment of the candle holder portion of the present invention birthday cake cover and candle holder shown partially sectioned.

FIG. 8 sets forth an alternate embodiment of the candle support system of the present invention in that a surface 65 defines an upwardly extending, generally cylindrical candle support 67 which in turn defines a central candle recess 66. In similarity to recess 43, recess 66 defines a recess bottom 68 providing the above-described sealing function. Candle 78 is inserted into candle recess 66 and defines an end 70 which rests upon recess bottom 68.

While the present invention birthday cake cover and candle holder may be fabricated from any number of materials, it is, in its preferred form, molded from an inexpensive material such as plastic or the like. However, it will be apparent to those skilled in the art that any number of materials may be utilized and any number of shapes and sizes may be provided without departing from the spirit and scope of the present invention.

What has been shown is a novel birthday cake cover and candle holder which permits the use and appreciation of birthday candles in association with a birthday cake and participation in the customary ceremonial blowing out of the birthday cake candles by the birthday celebrant without the attendant disadvantage of lack of sanitary conditions and destruction of the cake decorations.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A cake cover and candle holder comprising:

an elongated support having a first portion for insertion into a cake, a second portion, and an expanded portion intermediate said first and second portions;

a generally planar cover having a planar surface and defining a center aperture and a plurality of candle recesses;

said cover being supported by said elongated support above the cake bypassing said second portion through said center aperture and resting said cover upon said expanded portion of said elongated support.

2. A cake cover and candle holder as set forth in claim 1 wherein said generally planar cover is formed of a transparent material.

3. A cake cover and candle holder as set forth in claim 2 wherein said elongated support comprises a elongated cylindrical member and wherein said expanded portion comprises an outwardly extending ring.

4. A cake cover and candle holder as set forth in claim 2 wherein said generally planar cover defines an inner region free of said candle recesses.

5. A cake cover and candle holder as set forth in claim 4 wherein said inner region defines an inscription.

6. A cake cover and candle holder as set forth in claim 4 wherein said inner region defines a surface suitable for writing an inscription thereon.

7. A cake cover and candle holder as set forth in claim 2 wherein said generally planar cover is circular.

8. A cake cover and candle holder as set forth in claim 2 wherein said generally planar cover is square.

9. For use in supporting a plurality of candles above a cake, a cake cover and candle holder comprising:

a planar support defining an outer edge, a center aperture and a continuous surface therebetween, said continuous surface defining a plurality of candle recesses;

an elongated support having a first end configured to be inserted into and retained by a cake, a second end extending upwardly from said cake once said first end is inserted therein, and an expanded portion defined in said elongated support above said cake, said second portion extending through said center aperture and said expanded portion supporting said planar support above said cake.

10. A cake cover and candle holder as set forth in claim 9 wherein said planar support defines a pair of outwardly extending handle portions.

11. A cake cover and candle holder as set forth in claim 10 wherein said planar support is circular.

12. A cake cover and candle holder as set forth in claim 10 wherein said planar support is square.

* * * * *